US006892883B1

(12) United States Patent
Brumfield et al.

(10) Patent No.: US 6,892,883 B1
(45) Date of Patent: May 17, 2005

(54) CAKE COVER ASSEMBLY

(76) Inventors: Wilma J. Brumfield, P.O. Box 195, Bellaire, TX (US) 77402; Etoya L. Brumfield, 3315 Oyster Cove Dr., Missouri City, TX (US) 77459

( * ) Notice: Subject to any disclaimer, the term of this patent is extended or adjusted under 35 U.S.C. 154(b) by 116 days.

(21) Appl. No.: 10/609,423

(22) Filed: Jun. 27, 2003

(51) Int. Cl.[7] ..... B65D 85/00
(52) U.S. Cl. ..... 206/459.5; 206/499; 206/223; D7/610; D26/10
(58) Field of Search ..... 206/459.5, 508, 206/519, 499, 223; D7/610; D26/10

(56) References Cited

U.S. PATENT DOCUMENTS 2,960,770 A * 11/1960 Valenta ..... 33/1 F
3,338,395 A * 8/1967 Silverstein ..... 206/575
3,736,214 A * 5/1973 Birnie ..... 428/7
3,819,455 A 6/1974 Mackendrick
4,375,862 A 3/1983 Kurinsky et al.
4,721,455 A * 1/1988 Barfus ..... 431/295
4,802,577 A * 2/1989 O'Leary ..... 206/278
4,884,966 A 12/1989 Wexler
4,909,438 A * 3/1990 Viti ..... 239/34
D307,227 S 4/1990 Siblio et al.
4,938,688 A 7/1990 Wexler
5,096,274 A 3/1992 Fuschetto et al.
5,582,478 A * 12/1996 Ambrosino ..... 362/234
D490,276 S * 5/2004 Pereira et al. ..... D7/610

* cited by examiner

*Primary Examiner*—Jila M. Mohandesi

(57) ABSTRACT

A cake cover assembly for preserving freshness of a cake, permitting decoration of the cover instead of directly on the cake, preventing contamination of the cake by foreign materials, and holding candles to prevent wax from getting on the cake includes a pan for holding the cake, a side shield having an upper opening, and a cover member slidably engageable to the side shield. The cover member has tracks for receiving tiles to spell out a desired message. The cover member also includes candle holders for receiving and holding candles in an upright position.

6 Claims, 4 Drawing Sheets

10
20
22
24
30
32
33
34
36
38
40
42
44
46
50
60
62

CAKE COVER ASSEMBLY

BACKGROUND OF THE INVENTION

1. Field of the Invention

The present invention relates to cake covers and more particularly pertains to a new cake cover assembly for preserving freshness of a cake, permitting decoration of the cover instead of directly on the cake, preventing contamination of the cake by foreign materials, and holding candles to prevent wax from getting on the cake.

2. Description of the Prior Art

The use of cake covers is known in the prior art. U.S. Pat. No. 4,884,966 describes a transparent plastic cover that holds candles. Another type of cake cover is U.S. Pat. No. 4,938,688 also having a transparent plastic cover that holds candles. U.S. Pat. No. 3,819,455 also shows a shield for a cake that holds candles. U.S. Pat. No. 4,375,862 shows a pan and dome cover combination. U.S. Pat. No. 5,096,274 is a celluloid cover that holds conventionally shaped candles as well as numeral shaped candles. U.S. Pat. No. Des. 307,227 shows an ornamental appearance for a cover that holds candles.

While these devices fulfill their respective, particular objectives and requirements, the need remains for a device that holds both candies and tiles to permit placement of a customizable message on the cover itself instead of on the cake.

SUMMARY OF THE INVENTION

The present invention meets the needs presented above by providing a pan for holding a cake, a side shield attachable to the pan to protect the sides of the cake, and a cover slidably engageable to the side shield that includes candle holders and tracks for receiving tiles.

Still yet another object of the present invention is to provide a new cake cover assembly that substantially protects a cake from drying out.

Even still another object of the present invention is to provide a new cake cover assembly that protects a cake from being pierced by candles leading to quicker drying out and wax accumulation on the surface of the cake.

Yet even another object of the present invention is to permit customization of a message on the cover instead of directly on the cake surface, thus facilitating correction of misspellings.

To this end, the present invention generally comprises a pan for holding the cake, a side shield having an upper opening, and a cover member slidably engageable to the side shield. The cover member has tracks for receiving tiles to spell out a desired message. The cover member also includes candle holders for receiving and holding candles in an upright position.

There has thus been outlined, rather broadly, the more important features of the invention in order that the detailed description thereof that follows may be better understood, and in order that the present contribution to the art may be better appreciated. There are additional features of the invention that wilt be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
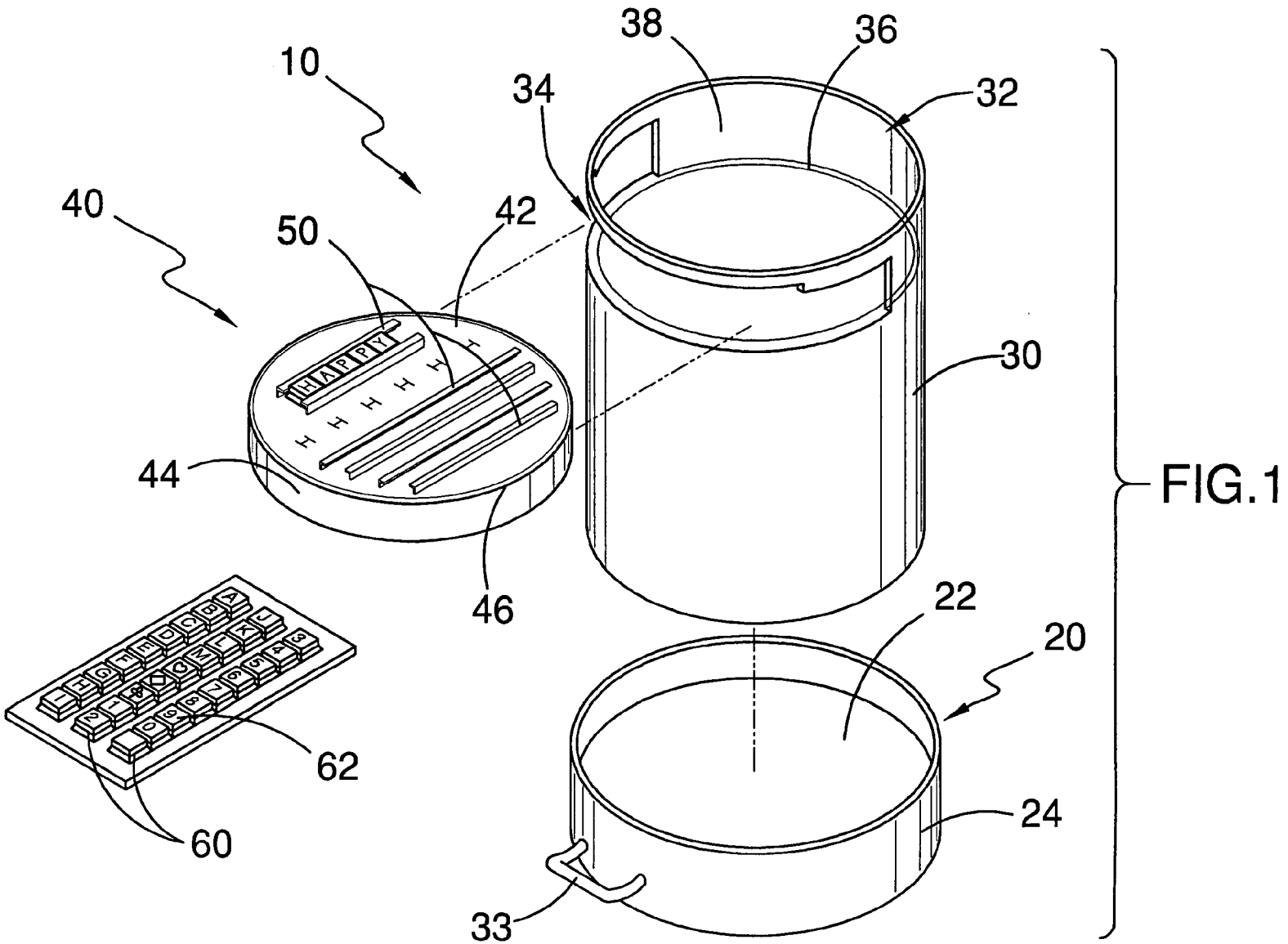
FIG. 1 is a perspective view of a new cake cover assembly according to the present invention.
Figure 2:
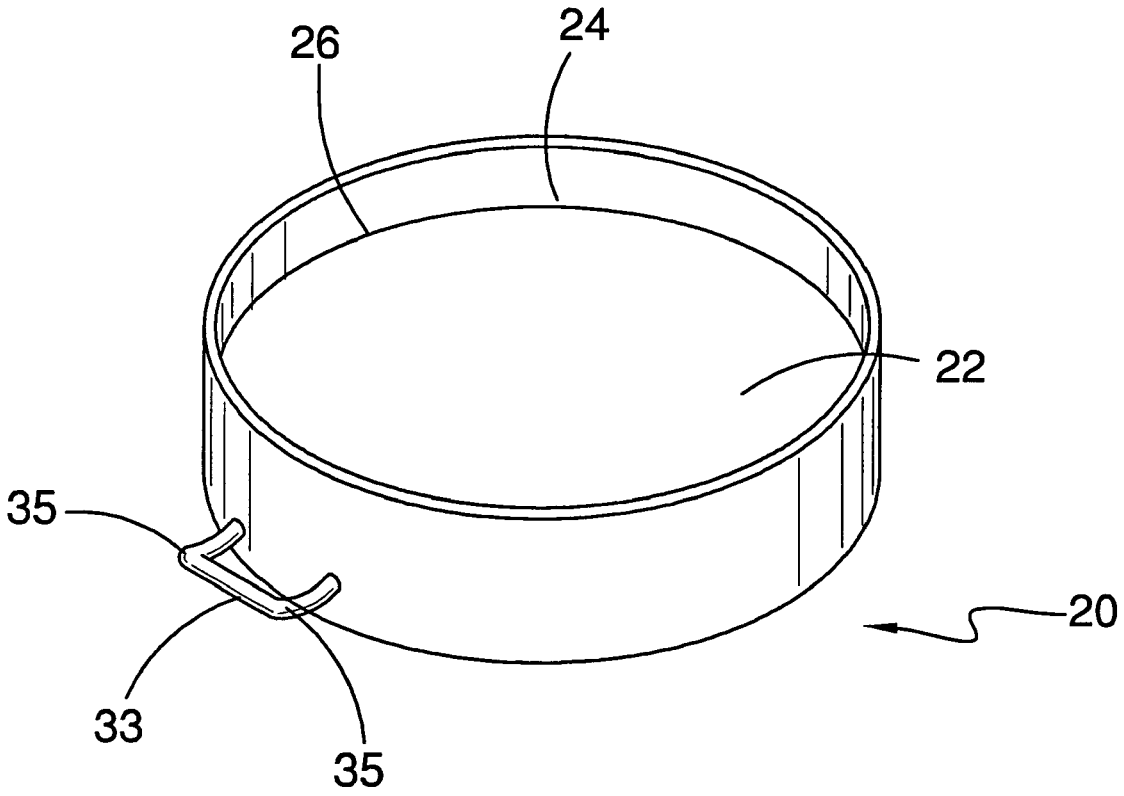
FIG. 2 is a perspective view of the bottom pan of the present invention.
Figure 3:
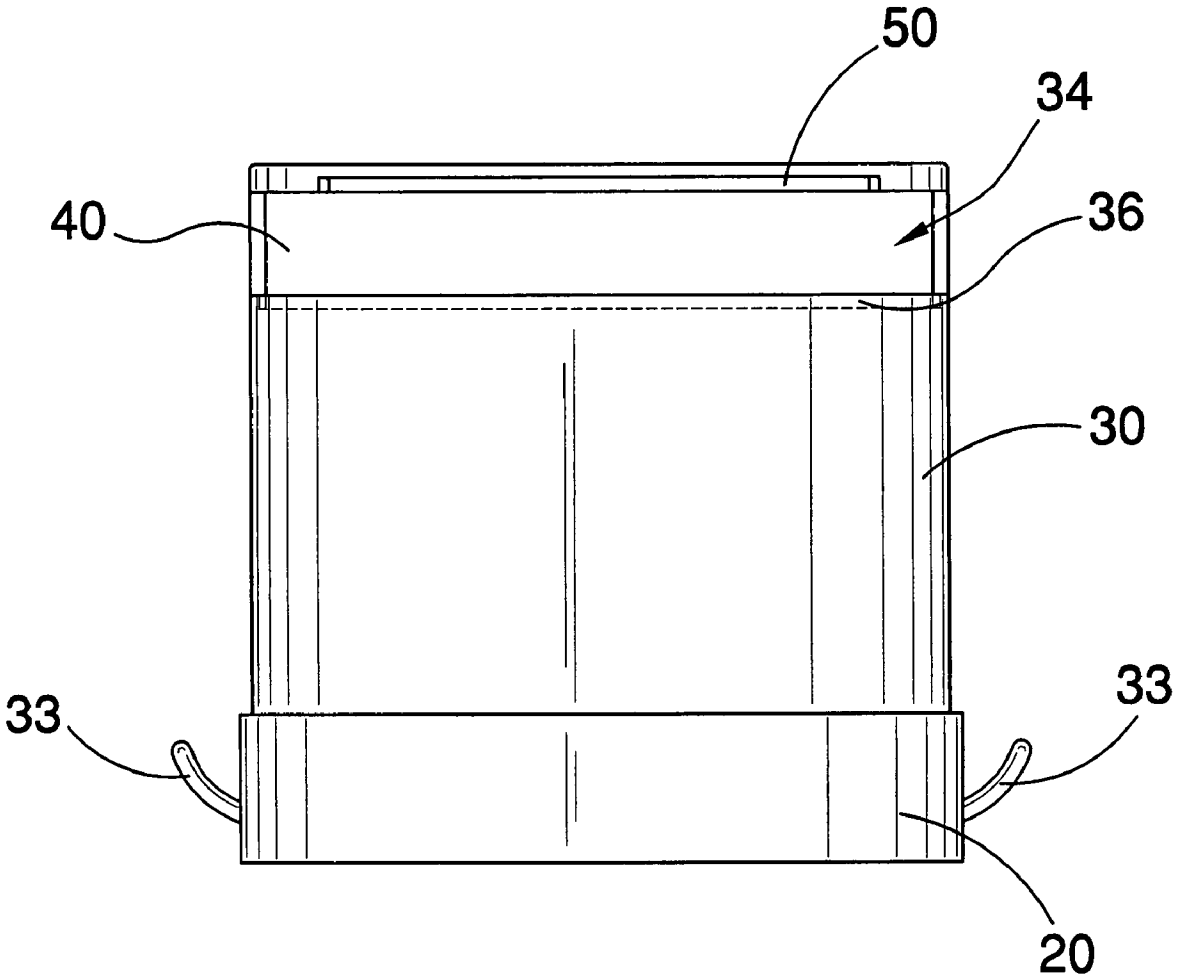
FIG. 3 is a side view of the present invention.
Figure 5:
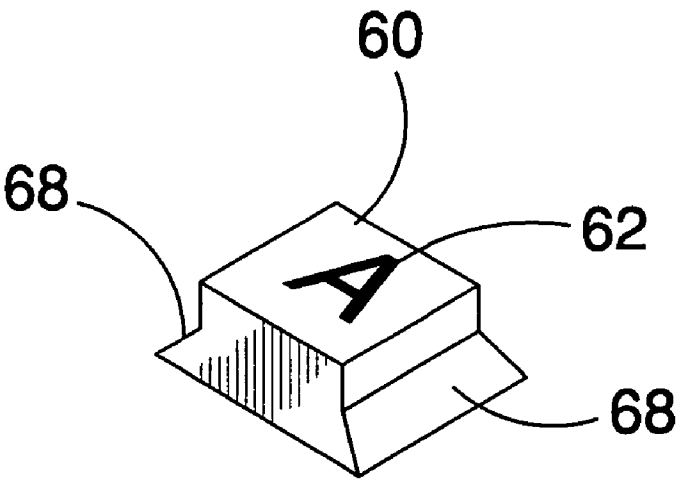
FIG. 5 is a perspective view of one of the tiles of the present invention.
Figure 4:
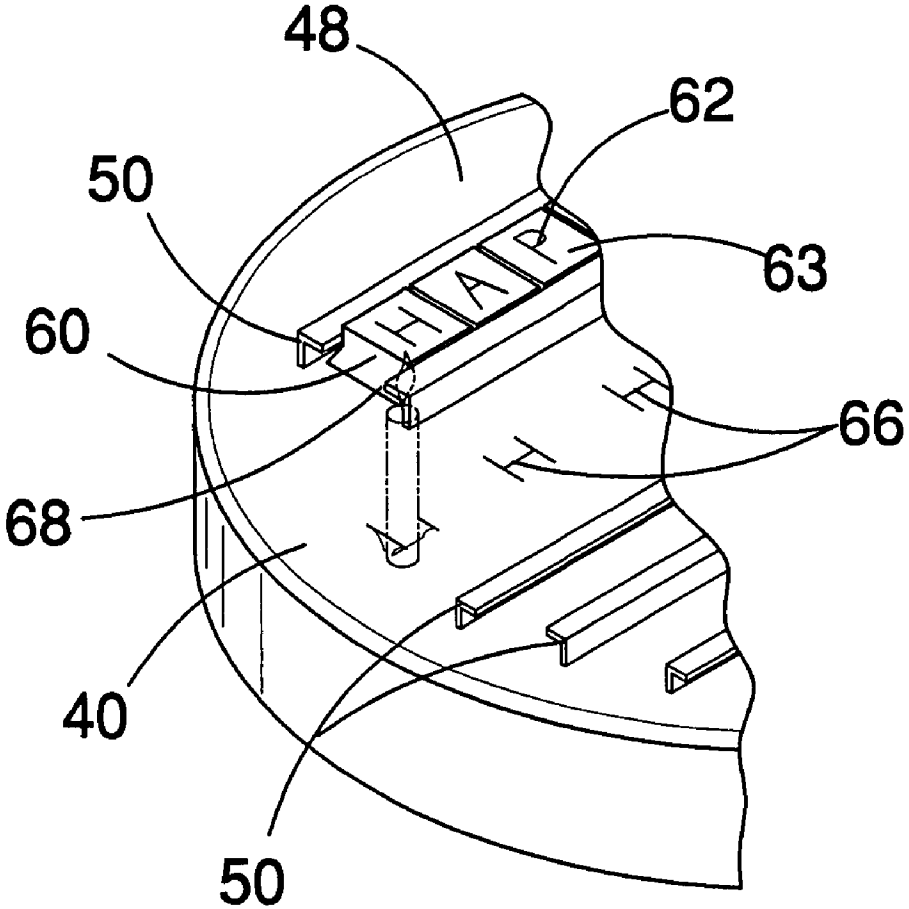
FIG. 4 is an enlarged view of the cover tracks and tiles of the present invention.

With reference now to the drawings, and in particular to FIGS. 1 through 5 thereof, a new cake cover assembly embodying the principles and concepts of the present invention and generally designated by the reference numeral 10 will be described.

As best illustrated in FIGS. 1 through 5, the cake cover assembly 10 generally comprises a bottom pan 20 having a bottom panel 22 and a sidewall 24 extending upwardly from an outer perimeter 26 of the bottom panel 22. A generally tubular side shield member 30 is insertable into the bottom pan 20 such that the side shield member 30 extends upwardly from the bottom pan 20. The side shield member 30 has an open top 32 and a slot 34 positioned adjacent the top 32. A lip 36 extends inwardly from an interior surface 38 of said side shield member 30. A cover member 40 is provided that has a top panel 42 and a perimeter wall 44 extending downwardly from an outer perimeter edge 46 of the top panel 42. The cover member 40 is slidable into the slot 34 in the side shield member 30 such that the top panel 42 closes the open top 32 of the side shield member 30.

A plurality of spaced tracks 50 are coupled to a top surface 48 of the cover member 40. A plurality of tiles 60 each have alphanumeric indicia 62 thereon. Alternately, some of the tiles 60 may have symbols or emblems, particularly such as those related to specific events or holidays like a pine tree for Christmas, balloons for a birthday, cloverleaf for St. Patrick's Day, etc. Each of the tiles 60 is slidably engageable to the spaced tracks 50 to spell out a desired message.

A pair of handles 33 are coupled to the sidewall 24 of the bottom pan 20. Each of the handles 33 is extendable between an extended position and a retracted position. Typically, each handle 33 is generally U-shaped and the outer arm portions 35 of each handle 33 are slidable through the sidewall 24. The sidewall extends downwardly from a perimeter edge of the bottom panel to position the bottom panel in spaced relationship to a surface on which the sidewall rests. The handles are positioned such that the handles slide in and out below the bottom panel to prevent damage to the cake.

A plurality of candle holding flaps 66 are positioned in the top panel 42 of the cover member 40. The flaps are generally formed by H-shaped slits cut into the cover member 40 and the flaps resiliently hold each candle inserted into the slits.

In an embodiment, each of the spaced tracks 50 is generally L-shaped. Each of the tiles 60 has a flared lower edge 68 for inserting into the spaced tracks 50. Thus, a top surface 63 of each letter piece 60 inserted into the spaced tracks 50 is spaced above the tracks 50.

In use, a cake is placed in the bottom pan. The side shield member is positioned over the cake. The tiles may be put into place before or after insertion of the cover member into the slot in the side shield member. When desired, candles may be inserted into the depressions in the top panel after the cover member has been inserted into the slot. The handles may be extended to facilitate carrying the cake cover assembly.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A cake cover assembly comprising:

a bottom pan having a bottom panel and a sidewall extending upwardly from an outer perimeter of said bottom panel;

a generally tubular side shield member insertable into said bottom pan such that said side shield member extends upwardly from said bottom pan, said side shield member having an open top and a slot positioned adjacent said top;

a cover member having a top panel and a perimeter wall extending downwardly from an outer perimeter edge of said top panel, said cover member being slidable into said slot in said side shield member such that said top panel closes said open top of said side shield member;

a plurality of spaced tracks coupled to a top surface of said cover member; and a plurality of tiles, each of said tiles having alphanumeric indicia thereon, each of said tiles being slidably engageable to said spaced tracks to spell out a desired message.

2. The cake cover assembly of claim 1, further comprising:

a plurality of handles coupled to said sidewall of said bottom pan.

3. The cake cover assembly of claim 2, further comprising:

each of said handles being extendable between an extended position and a retracted position.

4. The cake cover assembly of claim 1, further comprising:

a plurality of candle holding flaps in said top panel of said cover member.

5. The cake cover assembly of claim 1, further comprising:

each of said spaced tracks being generally L-shaped;

each of said tiles having a flared lower edge for inserting into said spaced tracks whereby a top surface of each letter piece inserted into said spaced tracks is spaced above said tracks.

6. A cake cover assembly comprising:

a bottom pan having a bottom panel and a sidewall extending upwardly from an outer perimeter of said bottom panel;

a generally tubular side shield member insertable into said bottom pan such that said side shield member extends upwardly from said bottom pan, said side shield member having an open top and a slot positioned adjacent said top;

a cover member having a top panel and a perimeter wall extending downwardly from an outer perimeter edge of said top panel, said cover member being slidable into said slot in said side shield member such that said top panel closes said open top of said side shield member;

a plurality of spaced tracks coupled to a top surface of said cover member;

a plurality of tiles, each of said tiles having alphanumeric indicia thereon, each of said tiles being slidably engageable to said spaced tracks to spell out a desired message;

a plurality of handles coupled to said sidewall of said bottom pan;

each of said handles being extendable between an extended position and a retracted position;

a plurality of candle holding flaps in said top panel of said cover member;

each of said spaced tracks being generally L-shaped;

each of said tiles having a flared lower edge for inserting into said spaced tracks whereby a top surface of each letter piece inserted into said spaced tracks is spaced above said tracks.

* * * * *